US005123229A

United States Patent [19]

Dardaine et al.

[11] Patent Number: 5,123,229

[45] Date of Patent: Jun. 23, 1992

[54] METHOD OF AND DEVICE FOR TRANSFERRING LIDS, COVERS OR THE LIKE INTO A MACHINE FOR THE STERILE CONDITIONING OF CONTAINERS

[75] Inventors: Edgar Dardaine, Sorel Moussel; Laurent Le Naour, Vernouillet, both of France

[73] Assignee: Dardaine Industries S.A., France

[21] Appl. No.: 616,401

[22] Filed: Nov. 21, 1990

[30] Foreign Application Priority Data

Nov. 21, 1989 [FR] France ..... 89 15263

[51] Int. Cl.[5] ..... B65B 55/04; B65B 41/04

[52] U.S. Cl. ..... 53/426; 53/485; 53/167; 53/306; 53/310; 53/312; 198/468.2; 271/268

[58] Field of Search ..... 53/167, 296, 298, 310, 53/312, 329, 373, 426, 427, 478, 306, 425; 198/468.2, 468.3, 468.9; 271/268, 14, 266; 426/407

[56] References Cited

U.S. PATENT DOCUMENTS

| | | | |
|---|---|---|---|
| 3,491,510 | 1/1970 | Sternau | 53/329 X |
| 3,501,896 | 3/1970 | Von Stoeser et al. | 53/296 X |
| 3,618,293 | 7/1969 | Loewenthal | 53/296 |
| 3,687,261 | 8/1972 | Guckel . | |
| 3,703,066 | 11/1972 | Marion et al. | 53/296 |
| 3,722,662 | 3/1973 | Wakabayashi et al. | 198/468.2 X |
| 3,766,709 | 10/1973 | Zausner | 53/167 |
| 3,783,581 | 1/1974 | Pierce | 53/426 |
| 3,908,340 | 9/1975 | Erhardt | 53/373 X |
| 4,226,072 | 10/1980 | Balzer et al. | 53/298 |
| 4,691,817 | 9/1987 | Haar | 271/268 X |
| 4,707,334 | 11/1987 | Gerhard | 53/167 X |
| 4,969,915 | 11/1990 | Hatanaka et al. | 53/426 X |
| 4,987,726 | 1/1991 | Pethö et al. | 53/425 X |
| 5,006,028 | 4/1991 | Jackson | 198/468.2 X |

FOREIGN PATENT DOCUMENTS

| | | |
|---|---|---|
| 170969 | 7/1904 | Fed. Rep. of Germany . |
| 1235057 | 6/1971 | United Kingdom . |

*Primary Examiner*—Horace M. Culver

*Attorney, Agent, or Firm*—Ostrolenk, Faber, Gerb & Soffen

[57] ABSTRACT

A method and device for transferring lids into a machine for the sterile conditioning of containers, the device comprising two elongated parallel nipper-holding members extending with one end into a sterile container-conditioning enclosure, one of these two members being reciprocally movable with respect to the other nipper-holding member which remains stationary being held against translatory motion. The device is adapted to transferring, depositing and provisionally securing lids onto containers or cups filled with any product or foodstuff.

5 Claims, 3 Drawing Sheets

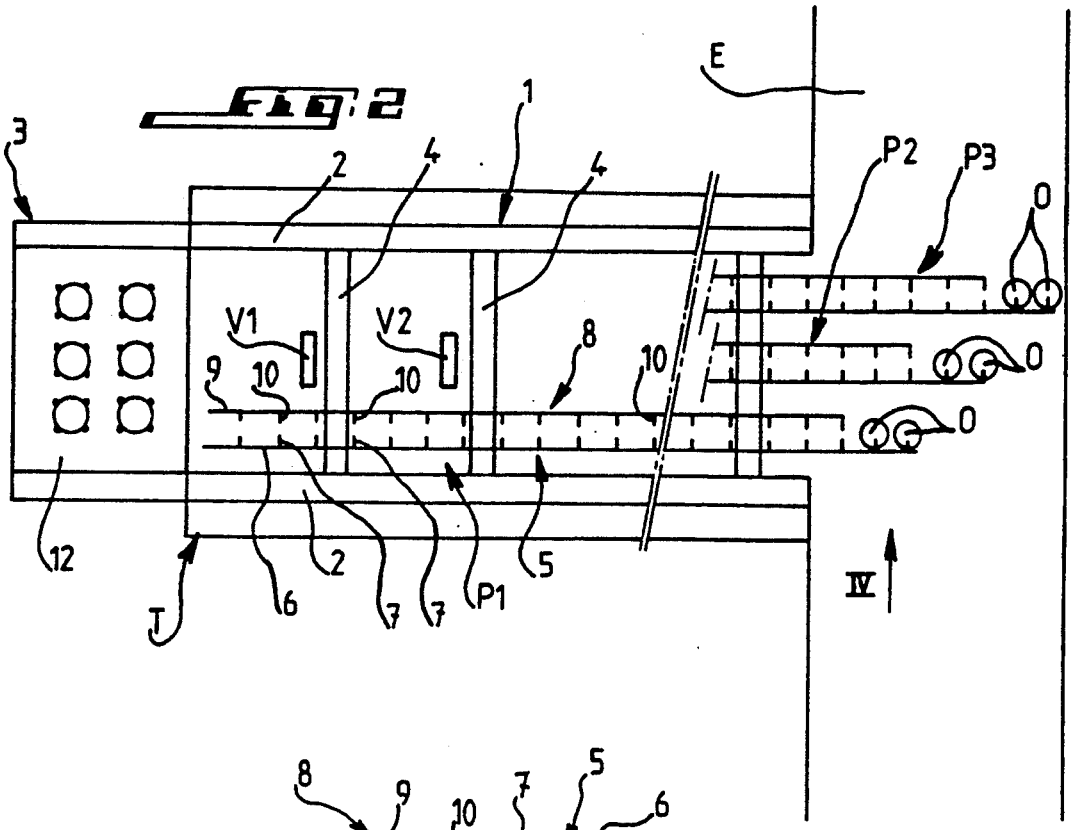
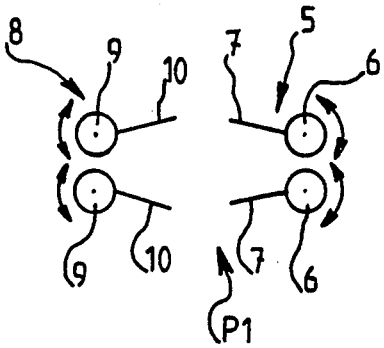
Fig. 3
Fig. 4
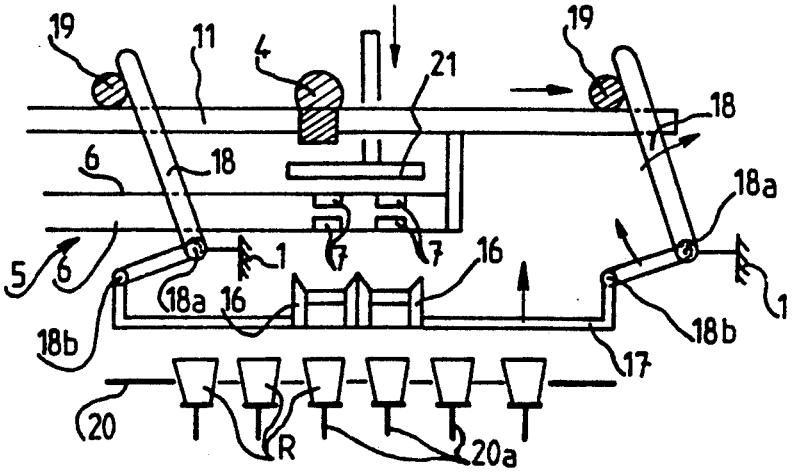

METHOD OF AND DEVICE FOR TRANSFERRING LIDS, COVERS OR THE LIKE INTO A MACHINE FOR THE STERILE CONDITIONING OF CONTAINERS

The present invention relates essentially to a method of transferring lids, covers or caps into a machine for the sterile conditioning of containers to receive such lids, covers or caps, for instance cups.

It is also directed to a device for carrying out this method.

There are already generally known methods for transferring lids, covers or caps into a machine for conditioning containers which grip the lids in order to convey them subsequently towards the machine and a sterile enclosed space, where they are laid down or released and then heat-sealed onto said containers which may contain, for example, a foodstuff.

These methods however suffer from the problem that the mechanical means for transferring the lids necessarily moves along a path of travel between the non-sterile outer atmosphere and the sterile enclosure of the machine where the containers are conditioned so that the sterility of the enclosure is eventually destroyed or at least altered or impaired. This as is understandable, would be detrimental to the quality of the conditioned products.

It is therefore desirable to provide a method and device for transferring lids which solves the technical problem of retaining the sterility of the enclosure while conveying lids from the outside into the sterile enclosure.

For that purpose the subject matter of the invention is a method of transferring lids, covers or like caps into a machine for the sterile conditioning of containers, which consists of gripping the lids for carrying them subsequently towards the machine where they are laid down in a sterile atmosphere onto the containers to be closed by said lids. The method consists of conveying the lids toward the machine and gripping each lid with a first nipper from a slidable series of first nippers, then displacing it towards the sterile atmosphere of the machine, transferring the lid to a second nipper in confronting relationship with the first nipper, and part of a stationary series of second nippers releasing the lid from the first nipper and causing the series of first nippers to move back to its initial position so that it may grip a second lid and at the same time by means of another nipper of the series of first nippers grip the lid already gripped by the second nipper, opening this second nipper, and transferring both lids gripped by the first towards the sterile atmosphere of the machine. The above steps may be repeated for as long as additional lids or covers require transferring into the sterile regions of the machine.

It is understood that transferring of lids from one nipper to another will achieve a progressive and mechanically safe and reliable travel of the lids towards the machine. These lids may exhibit any size and shape suitable for covering the containers.

According to one feature of this method each lid is deposited into the conditioning machine onto a receptacle underneath which a container to be closed or sealed is placed and a previous local or pinpoint-like welding of the lid onto the container is carried out while disengaging this lid from the receptacle by a thrust upon the top of the lid, and preferably a simultaneous upward thrust on the container subsequently. The lid is then heat-sealed onto the container.

The invention is further directed to a device for carrying out the above method, which comprises at least two elongated substantially parallel nipper-holding members extending with one end into an enclosure for the sterile conditioning of containers, one of these members being adapted to be moved along its longitudinal direction according to a reversible motion, and the other nipper-carrying member being stationary.

It should be pointed out that the stationary nipper-holding member and most of the movable nipper-holding member remain within the sterile enclosure so that the sterility of this enclosure is retained, which would not be the case if the transfer of the lids is effected through mechanical means continuously passing from the outside to the inside of the sterile enclosure.

The device according to this invention is further characterized in that each nipper-carrying member includes a series of two parallel and rotary rods each one comprising a plate or the like, each series of plates being arranged in opposite relationship with nippers of a complementary nipper-holding members when the slidable nipper holding member is in its initial position.

According to another feature of this device, the end of the nipper-holding members opposite the end extending into the conditioning enclosure is connected to a frame for a lid-storage magazine which includes a system for transferring, through suction cups or the like lids from the storage magazine towards the movable nipper-holding member and means for actuating said transfer system and said movable nipper-holding member.

Both nipper-carrying members in the region between the aforesaid frame and the container-conditioning enclosure pass along a passage-way below which is arranged a system for the sterilization of the lids during their travel. The passage-way is surrounded by a tunnel connecting in fluid-tight relationship a frame for the conditioning enclosure.

Within the conditioning enclosure and underneath the end of both nipper-holding members which extends into this enclosure, is at least one bar supporting at least one receptacle for the lids and vertically operable by a carriage bearing the movable nipper-holding member.

Another preferred characteristic is that the aforesaid bar is operable through at least one lever or the like and is interposed between means for pushing the containers upward and a head for pushing the lids onto the containers so that they join at predetermined positions or weld points.

The invention will be better understood, and further objects, details and advantages thereof will appear from the following explanatory description with reference to the accompanying diagrammatic drawings given by way of a non-limiting example only, and illustrating a presently preferred specific embodiment of the invention.

BRIEF DESCRIPTION OF THE DRAWINGS

FIG. 2 is a diagrammatic and fragmentary top view of this device.

FIG. 3 is an end view seen in the direction of arrow III of FIG. 1 and showing both nipper-holding members.

FIG. 4 is a diagrammatic elevational view seen in the direction of the arrow IV of FIG. 2 and showing the end of the nipper-holding members extending into the sterile enclosure of the container-conditioning machine and associated means allowing the lids to be laid down onto the containers through the medium of receptacles.

Figure 1:
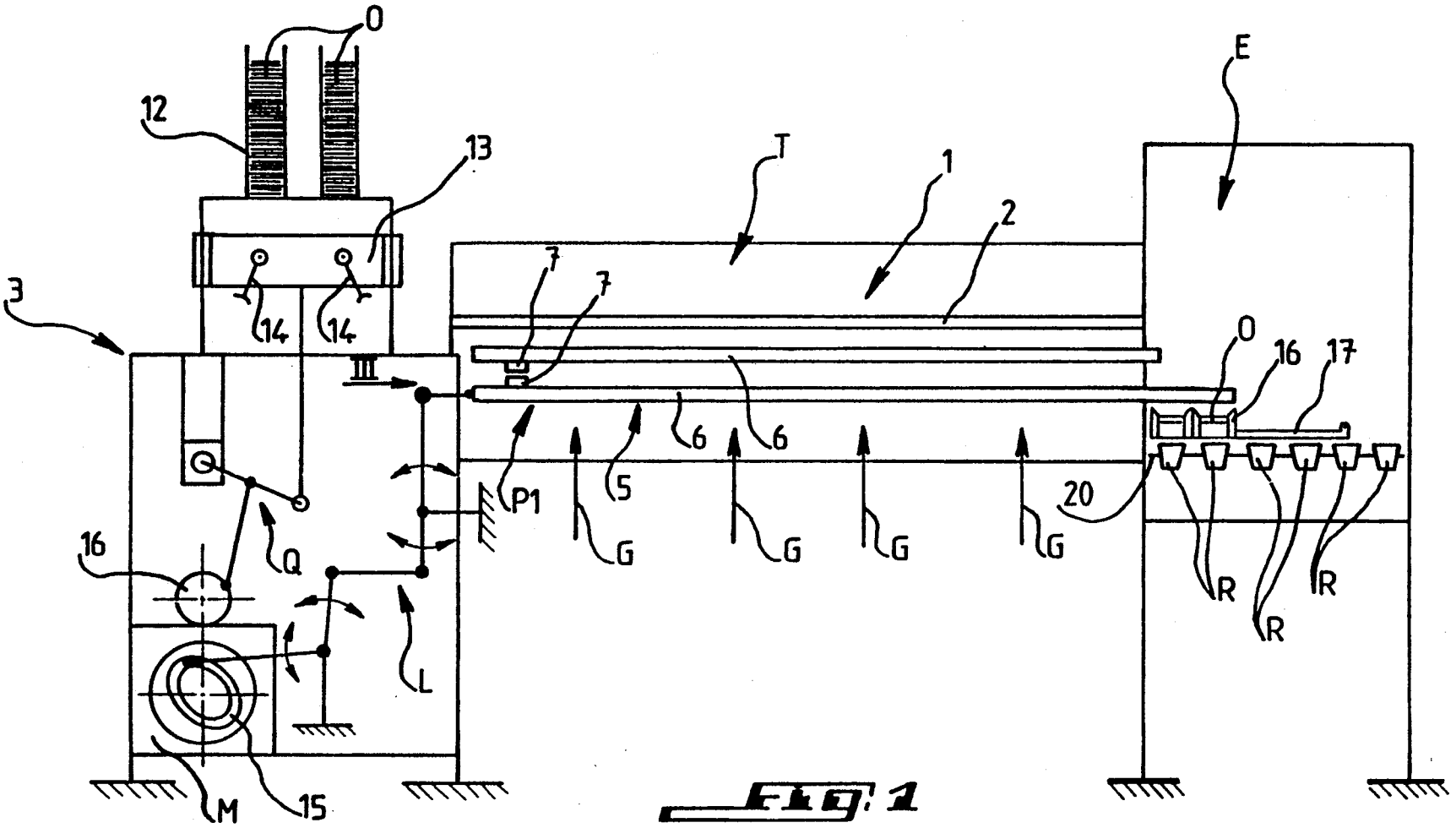
FIG. 1 is a diagrammatic partial side view of a device according to the principles of the invention.

Referring in particular to FIGS. 1 and 2 there is shown a device according to this invention consisting essentially of a frame 1 with horizontal beams 2 supporting a plurality of nipper-holding members adapted to carry along lids 0 towards a machine for the conditioning of containers or cups R. The device includes means for the conveyance, filling and heat-sealing of these containers which have not been shown since they are not part of the present invention and which are working within a sterile enclosure E.

The horizontal main frame 1 together with its nipper-holding members form a passageway or gangway for the lids 0. This passageway is supported at one end by a frame 3 resting on the ground and at its other end by the machine or enclosure E for the sterile conditioning of the containers R.

FIGS. 1 to 3 illustrate that the frame 1 supports through the medium of cross-members 4 interconnecting the beams 2 several pairs of nipper-holding members, three according to the exemplary embodiment shown designated as $P_1$, $P_2$ and $P_3$, respectively. These pairs of nipper-holding members exhibit identical structures and for the sake of greater simplicity their structure will be described hereinafter with reference to that pair of nipper-holding members $P_1$ which is shown in FIG. 3.

One nipper-holding member 5 of the pair $P_1$ consists of two parallel rotary rods 6 which each comprise a series or row of plates 7. It should be understood that the rotation of the rods 6 in either direction may cause the opening or the closing of the nipper consisting of both plates 7 arranged in mutually confronting or opposite relationship, i.e. for gripping or releasing of one lid 0.

The other nipper-holding member 8 of the pair $P_1$ also consists of two parallel rotary rods 9 each comprising a series or row of plates 10 arranged in front of or in opposite relationship with plates 7 as shown in FIG. 3. It is therefore already appreciated that it will be possible to transfer the lids from one nipper 5 to another nipper 8 or vice versa through actuation of these nippers.

The nipper-holding member 5 consisting of both rods 6 is fastened to a carriage 11 shown in FIG. 4 and slidably mounted on the cross-members 4 of the frame 1. Thus the nipper-holding member 5 may be moved along its longitudinal direction according to a reciprocating motion which will be described in detail later in connection with the operation of the device.

On the contrary, the other nipper-holding member 8 is fastened to cross-members 4 and remains stationary or is held against translatory motion. In other words the nipper-holding member 5 is movable with respect to the other nipper-holding member 8 secured to the frame 1. Rods 6 and 9 in each nipper-holding member, may be rotated in either direction.

The three pairs of nipper-holding members $P_1$, $P_2$, and $P_3$ work in the same manner and extend with one end into the sterile enclosure E of the conditioning machine as shown in FIGS. 1 and 2. The other end of these nipper-holding members is operatively connected to the frame 3 which will be described now.

Both rods 6 of the nipper-holding member 5 may be rotated by a jack or actuator shown diagrammatically at V1 on FIG. 2 and which is fastened to frame 1 whereas both rods 9 of the other nipper-holding member 8, which as stated above are stationary or held against translatory motion, may be rotated by another jack or actuator V2. In summary the jacks or actuators V1 and V2 control the opening and the closing of the nippers 5 and 8, respectively.

FIG. 1 further illustrates frame 3 essentially comprising a storage magazine 12 for stacked lids 0, a slide 13, the displacement of which allows the rotation in either direction of suction cups 14 adapted to grip the lids 0 in the storage magazine 12 and to transfer them to the nipper-holding members. A motor-reducer set M allows the actuation of the slide 13 and also the reciprocating displacement in synchronized relationship of the nipper-holding member 5 and of course also of the movable nipper-holding member of the other pairs of nipper-holding members $P_2$ and $P_3$.

More specifically and as illustrated in FIG. 1, the motor-reducer set M controls the rotation of an annular camming path, track or like guideway 15 which through the agency of a series of pivotally connected links L provides for the horizontal translatory reciprocating motion of the carriage 11, i.e. of the nipper-holding member 5 consisting of both parallel rotary rods 6. Likewise the motor-reducer set M controls through the medium of an eccentric designated at 16 on FIG. 1 a set of levers Q adapted to cause the vertical reciprocating displacement of the slide 13 carrying the suction cups 14.

FIG. 1 shows diagrammatically by arrows G a system for the sterilization of the lids 0, which system may consist, for instance of a source of ultraviolet radiation or of hydrogen peroxide spray. A tunnel designated T surrounds the passageway for the lids 0 and connects in fluid-tight relationship the frame 3 to the sterile enclosure E.

Figure 5:
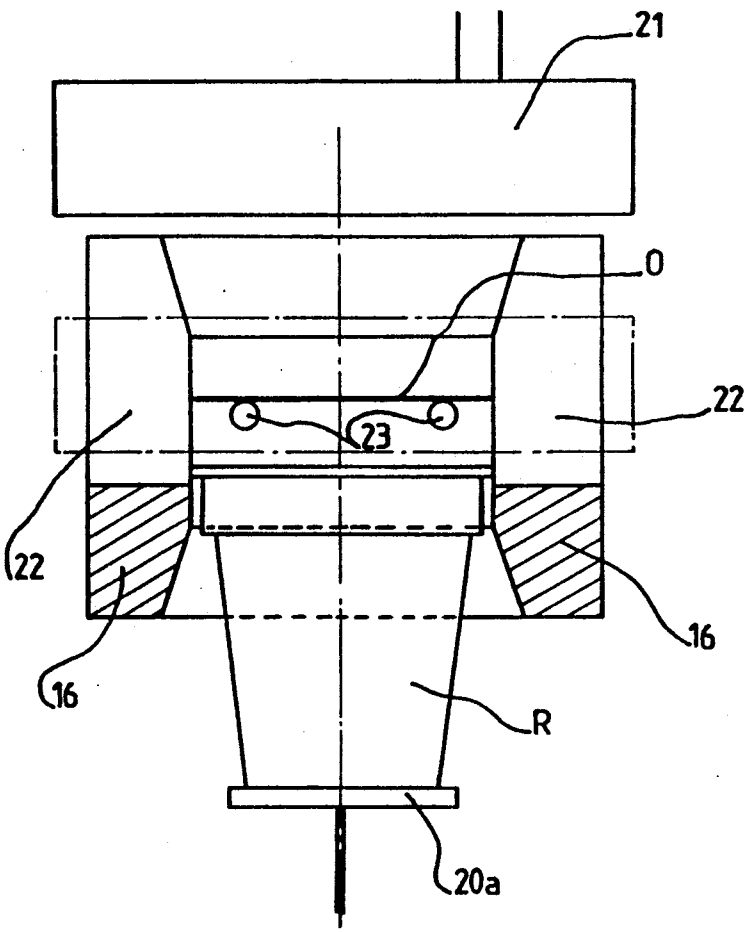
FIG. 5 is an enlarged view in axial section of a receptacle together with the essential elements which are associated therewith.

Referring now to FIGS. 4 and 5 there is shown at 16 a receptacle adapted to receive through gravity the lids 0 when at the end of their travel they are released by the plates 7 of the nipper-holding member 5.

Receptacles 16 are supported by a bar or the like 17 vertically operable by the carriage 11 supporting the nipper-holding members 5 and which as referred to hereinabove may be subjected to a reciprocating motion owing to a camming guideway 15 driven by the motor-reducer set M.

More specifically the vertical displacement of the bar 17 supporting the receptacles 16 may be carried out by levers 18 pivotally connected at 18*a* onto the frame 1 and at 18*b* onto the said bar, whereas the end of these levers may be operated by cams or the like 19 fastened to the carriage 11.

Underneath the bar 17 carrying the receptacles are provided pusher means 20*a* for pushing the containers R above the bar 20 of the conveyor which carries them into the sterile enclosure E.

Above the bar 17 supporting the receptacles 16 is provided a head 21 for the local and pinpoint-like welding of the lids 0 onto the containers R before the latter are finally closed subsequently by a heat-sealing head (not shown).

As shown in FIG. 5 each receptacle 16 exhibits a substantially cylindrical shape and comprises on the one hand two opposite slots 22 allowing the passage of the welding head 21 and on the other hand studs 23 for provisionally retaining one lid 0 released by the end of the nipper-holding member 5 remaining within the sterile enclosure E of the container-conditioning machine.

The operation of the device will be described more particularly with reference to FIG. 6.

Figure 6:
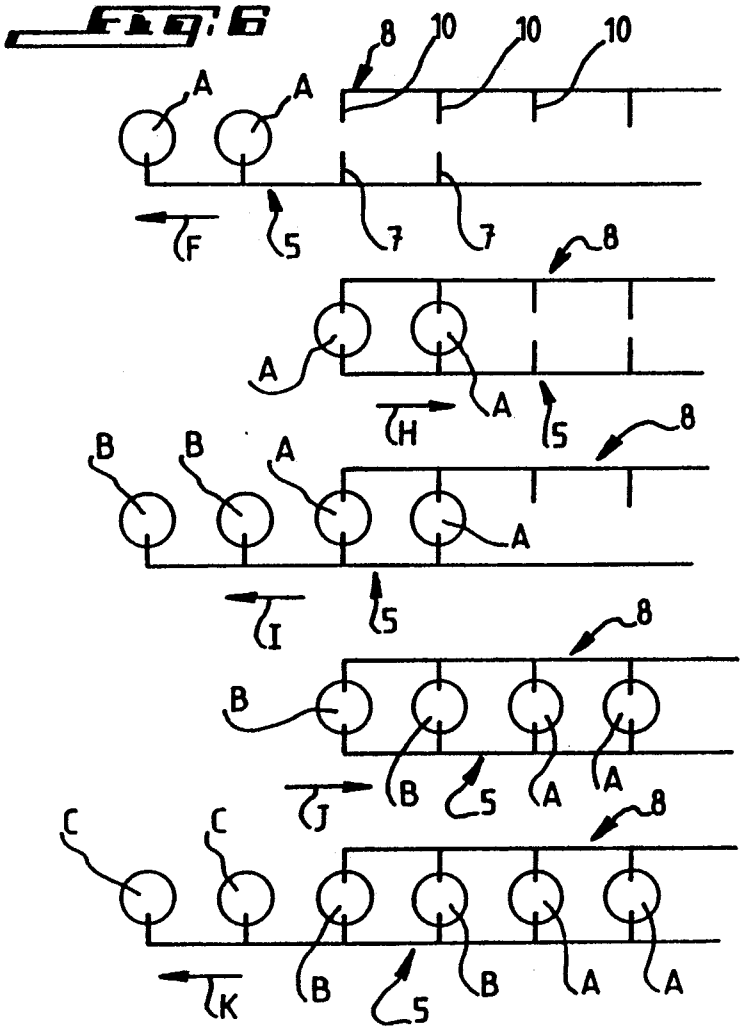
FIG. 6 is a diagrammatic view illustrating the sequence of the gripping operating steps allowing the lids to be carried along or fed into the machine for the sterile conditioning of the containers.

According to the exemplary embodiment shown the storage magazine 12 comprises two lines each one having three stacks of stacked lids so that the movable nipper-holding member 5 may simultaneously grip or take hold of two lids such as A (FIG. 6). The same holds true for the other pairs $P_2$ and $P_3$ of nipper-holding members. It should be pointed out, with reference to FIG. 2, that the pairs of nipper-holding members $P_1$, $P_2$, and $P_3$ extend into the sterile enclosure E according to an increasing length so as to lay down or discharge lids 0 by pairs (which lids have been sterilized during their travel within the tunnel T to the sterile enclosure E) as the supporting plates 20 for carrying the containers R are advanced within the sterile enclosure E.

According to the invention the operation will now be described hereinafter only upon considering both nipper-holding members 5 and 8 since the other nipper-holding members belonging to the pairs $P_2$ and $P_3$ are structurally the same and work in the same fashion.

The suction cups 14 first grip two lids 0 within the storage magazine 12 to then present them in front of two nippers of the nipper-holding member 5 (each nipper consisting of two plates 7 arranged in mutually confronting or opposite relationship), which nippers grip these two lids as seen at A on FIG. 6. It should be understood that the gripping of the lids may be accomplished only after the displacement of the nipper-holding member 5 has taken place in the direction of the arrow F towards the frame 3 so that it thus may grip the lids released by the suction cups 14.

Afterwards the nipper-holding member 5 is displaced in the direction of the arrow H as shown in FIG. 6 so that after the release of both lids A from the nippers of the member 5, these two lids may be gripped or taken up again by two nippers of the member 8 which are stationary or held against translatory motion.

Then the member 5 moves back or returns to its initial position in the direction of the arrow I for gripping from the suction cups 14 two other lids designated B. It should be pointed out here that upon gripping both lids B the two following or next nippers of the member 5 would simultaneously grip the two lids A standing by and already gripped by the nippers of the member 8.

The nippers of the member 8 retaining the lids A are then opened and the member 5 may then be moved in a translatory motion towards the sterile enclosure E in the direction of the arrow J as shown on FIG. 6.

The nippers of the member 8 are then closed for retaining the four lids A, B whereas the nippers of the member 5 are open.

Thus the member 5 may again move back or return towards the frame 3 in the direction of the arrow K for gripping from the suction cups 14 two other lids such as C and the sequence of operating steps referred to hereinabove would then be repeated as many times as desired to move as many covers as desired into the sterile enclosure.

It is therefore understood that owing to the passage of the lids from one nipper-holding member to the other one and to the reciprocating displacement of the member 5 with respect to the member 8 which remains immovable or held against translatory motion a stepwise travel of the lids towards the sterile enclosure E is achieved where they will be deposited in pairs by the end of the nipper-holding member 5 into two receptacles such as 16 inside of which they will be retained by the studs 23 as shown in FIG. 5.

At this stage there will occur a simultaneous downward motion of the welding head 21 which will cause the lid O to move past and beyond the stud 23 along with a rising or upward motion of the containers R owing to the pusher means 20*a* thereby carrying out a previous local or pinpoint-like welding of said lid onto the upper edge of the container R.

Then the lid O provisionally secured onto the container would pass below a heat-sealing head (not shown) which will finally seal or close the containers.

It should be recalled here that the pairs of nipper-holding members $P_2$ and $P_3$ will carry out the same sequence of operating steps as that described hereinabove in connection with the pair of nipper-holding members $P_1$, which means when referring to FIG. 2 that six containers carried by a plate such as 20 will each receive one lid O after having passed below the ends of the three pairs of nipper-holding members $P_1$, $P_2$ and $P_3$ which will each one allow two lids to be deposited in a sterile atmosphere into the conditioning enclosure E.

There has therefore been provided according to the invention a method of, and a device for, transferring lids using a small number of mechanical parts which remain within the sterile conditioning enclosure so that the sterility of said enclosure is maintained.

It should be understood that the invention is not limited to the embodiment described and illustrated which has been given by way of example only.

On the contrary the invention comprises all the technical equivalents of the means described as well as their combinations if the latter are carried out according to its gist and within the scope of the appended claims.

What is claimed is:

1. A method of transferring covers for sterile containers into a machine for the sterile conditioning of said containers, said method comprising the steps of (A) gripping a first cover with a reversibly slidable first series of nippers, said first series being in an initial position;

(B) sliding said reversibly slidable first series toward a region of a sterile atmosphere;

(C) gripping said first cover with a stationary second series of nippers arranged in confronting relationship with said first series of nippers;

(D) releasing said first cover from said first series of nippers, (E) causing said first series of nippers to return to said initial position;

(F) causing said reversibly slidable series of first nippers to grip at least one second cover while at the same time regripping said first cover;

(G) opening said second series of nippers to release said first cover;

(H) transferring all covers gripped by said first series of nippers by sliding said first series of nippers toward said region of sterile atmosphere;

(I) laying down at least one cover onto a receptacle underneath which is pushed a container to be closed, (J) thrusting said laid down cover onto said container, and then heat sealing said cover onto said container.

2. A device for transferring covers for sterile containers into a machine for the sterile conditioning of said containers comprising at least two elongated substantially parallel nipper holding members extending with one end into an enclosure for the sterile conditioning of containers, one of said members being movable along its longitudinal direction according to a reciprocating motion, and the other of said nipper-holding members being held against translatory motion, wherein both nipper-holding members pass above a means for the sterilization of any covers attached thereto and are surrounded along most of their longitudinal course by a tunnel connecting in fluid-tight relationship with the frame to a sterile conditioning enclosure.

3. A device according to claim 2, wherein said movable nipper-holding members includes a series of nippers each comprising two parallel rotary rods attached to a plate, each nipper being arranged in opposite relationship with a nipper of said stationary nipper-holding member.

4. A device according to claim 2, wherein below an end of at least one nipper-holding member is at least one member for receiving covers.

5. A device according to claim 4, further comprising means for pressing a cover in said receiving member onto one of said containers.

* * * * *